US006539566B1

(12) United States Patent
Hayes

(10) Patent No.: US 6,539,566 B1
(45) Date of Patent: Apr. 1, 2003

(54) PATIENT SUPPORT

(75) Inventor: Stephen Hayes, West Midlands (GB)

(73) Assignee: Huntleigh Technology PLC (GB)

( * ) Notice: Subject to any disclaimer, the term of this patent is extended or adjusted under 35 U.S.C. 154(b) by 0 days.

(21) Appl. No.: 09/601,598

(22) PCT Filed: Dec. 2, 1999

(86) PCT No.: PCT/GB99/04019

§ 371 (c)(1),
(2), (4) Date: Sep. 26, 2000

(87) PCT Pub. No.: WO00/33785

PCT Pub. Date: Jun. 15, 2000

(30) Foreign Application Priority Data

Jan. 21, 1998 (GB) ..... 9901221
Dec. 4, 1998 (GB) ..... 9826772

(51) Int. Cl.[7] ..... A61G 1/02
(52) U.S. Cl. ..... 5/618; 5/607; 5/611
(58) Field of Search ..... 5/607, 611, 617, 5/618, 627, 608, 610

(56) References Cited

U.S. PATENT DOCUMENTS 3,686,696 A * 8/1972 Lanigan ..... 5/611
3,818,516 A * 6/1974 Hopper et al. ..... 5/611
4,025,972 A 5/1977 Adams et al.
5,084,922 A 2/1992 Louit
5,317,769 A 6/1994 Weismiller et al.
5,365,622 A * 11/1994 Schirmer ..... 5/611
5,715,548 A * 2/1998 Weismiller et al. ..... 5/611

FOREIGN PATENT DOCUMENTS

| | | |
|---|---|---|
| DE | 4317208 | 6/1994 |
| EP | 0494551 | 7/1992 |
| EP | 0781517 | 7/1997 |
| GB | 1084020 | 9/1967 |
| GB | 1352764 | 5/1974 |
| WO | WO 01/74286 | 10/2001 |

* cited by examiner

*Primary Examiner*—Lynne H. Browne
*Assistant Examiner*—Fredrick Conley
(74) *Attorney, Agent, or Firm*—Brown Raysman Millstein Felder & Steiner, LLP

(57) ABSTRACT

A patient support apparatus comprises a base frame (10) supporting radius arms (15) on either side. The radius arms (15) support an upper frame (20), via cross tubes (16). Linear actuators (30, 31) act on the cross tubes (16) to raise, lower or tilt the upper frame (20). Further linear actuators (32, 33) are provided to profile platform sections (41, 42, 43). The actuators, their control systems, power and other functions e.g. patient weighing, air pumps, lights are all mounted centrally on the upper frame and housed within a single housing located almost entirely within the upper frame. The location of the actuators and housing provide a very low minimum height of the patient support apparatus, the single housing eliminating trailing cables and wires and ensuring easy cleaning and maintenance.

15 Claims, 7 Drawing Sheets

PATIENT SUPPORT

BACKGROUND OF THE INVENTION

The invention relates to patient support apparatus especially but not exclusively to hospital beds, patient trolleys, physiotherapy couches or the like.

It is known to have a profiling bed or trolley in which the mattress support is so arranged that it comprises three, four or more parts hinged together wherein angular adjustment of the individual parts provides an optimum position for patient comfort and/or nursing. Similarly, the mattress support may also be adjustable with respect to its height and tilt for nursing and certain medical/physiotherapy procedures. Examples of such beds are to be found in Patents EP 0488552 and EP 0498111 which show the use of powered actuators to provide articulation for variable height and tilt, and also profiling of the patient support surface.

However, these beds or trolleys, due to the location of the actuator components, do not provide a very low mattress to floor height with good ground clearance for access for patient moving, monitoring or treatment systems. The beds or trolleys have a minimum height to the top of the mattress support platform of 400 mm. The aim of the present invention is to reduce this minimum height to below 300 mm. This is an ideal height for patient entrance/exit or transfer.

In addition, because the actuators are positioned at a number of locations around the bed or trolley base frame, the associated power and control cables are an inconvenience and a potential hazard to the patient and nurse or carrier when using the bed or trolley. The power and control cables also require specific plug and socket connections that are potential hazard areas for entry of water during cleaning.

SUMMARY OF THE INVENTION

Accordingly, the invention provides a patient support apparatus comprising a base frame supporting an upper frame, the upper frame having a platform for supporting a mattress or the like, at least one powered actuator for varying the height and tilt of the upper frame and optionally at least one powered actuator for adjusting the profile of the platform wherein the said actuators are mounted centrally on the upper frame and arranged to lie substantially within the upper frame to achieve a very low minimum height of the patient support apparatus. The mounting of the height, tilt and profiling actuators centrally on the upper frame provides a compact arrangement with the actuators and associated power cables all located in one area on the upper frame. Also the arrangement of the actuators within the upper frame rather than on the base frame or in-between the base or upper frame allows the upper frame to almost meet the base frame in the lowest position for a very low mattress to floor height whilst still maintaining the desired ground clearance for access for patient moving, monitoring and treatment systems.

In a preferred embodiment the patient support apparatus comprises at least a pair of support arms interconnecting the base frame and the upper frame, each of the arms pivotally connected to each end of the base frame and extending towards the opposite end of the upper frame and connected to the upper frame to position the upper frame in a minimum position where the arms are fully collapsed to positions where the arms are elevated to varying degrees, said arms actuated by at least one powered actuator, said actuator(s) mounted centrally of the upper frame within the points of connection of the arms to the upper frame, and arranged to lie substantially within the upper frame. Preferably the support arms are collapsible to position the bed to the minimum position under the weight of the bed or trolley, without use of the powered actuators. This provides for mechanical emergency operation of the bed in the cardiopulmonery resuscitation (CPR) position in the absence of power supply or on the absent of power failure.

Preferably, the said actuators are mounted on the same plane within the upper frame to minimise the depth/volume occupied by the actuators within the upper frame. More preferably, all of the actuators are arranged to operate in a longitudinal direction parallel to the upper frame without any pivotal movement, resulting in a structure without bending moments to the actuators and thus less wear and tear on the actuators.

Preferably, the actuators are all located in a single housing, the housing also providing structural support to the actuators. More preferably said housing is arranged to span transversely centrally of the upper frame and located almost entirely within the upper frame.

The location of all the height, tilt and profiling actuators in a single housing, within the upper frame allows for the very low mattress to floor height but also the single housing is the only enclosure that requires sealing to prevent ingress of water during cleaning or body fluids during use, as opposed to several items on a conventional hospital bed or trolley. Furthermore, with the housing providing a structural casing for all the actuators and thereby eliminating the need for individual actuator casings, the overall number of components are minimised with the consequent benefits of reduced cost of manufacture.

Preferably, the housing may be located substantially under the seat section of the platform and optionally may be integral with the seat section of the platform to provide improved structural rigidity to the upper frame.

Preferably, the actuators are controlled by control means also located within the housing. The housing may also include means to record the patients' physical data or characteristics, for example height or weight and may include means to communicate with a patient and/or nurse interface module situated at the side or foot end of the bed.

In a preferred embodiment, load cells may be mounted on the actuators supporting the upper frame to provide an indication of load applied to the platform when a patient is lying thereon, and converted to patient weight by the control means within the housing.

Preferably, the housing could include means to illuminate the perimeter of the mattress platform on the floor, to give the patient clear vision when entering or exiting the bed when dark. Advantageously, such means could be patient or nurse controlled.

Preferably, the housing may include a pneumatic pump or means for attachment thereof to supply compressed air to operate a pressure relieving mattress supported upon the platform and/or compression garments for treatment of a patient lying upon the mattress.

Preferably, the housing as a unit may be secured to the upper frame by releasable fastenings to allow for removal of the housing from the upper frame for servicing or enhancement of the actuators and components housed within.

BRIEF DESCRIPTION OF THE DRAWINGS

The present invention will now be described in detail, by way of example only, with reference to the accompanying drawings in which.

DETAILED DESCRIPTION OF THE PREFERRED EMBODIMENT

Figure 1:
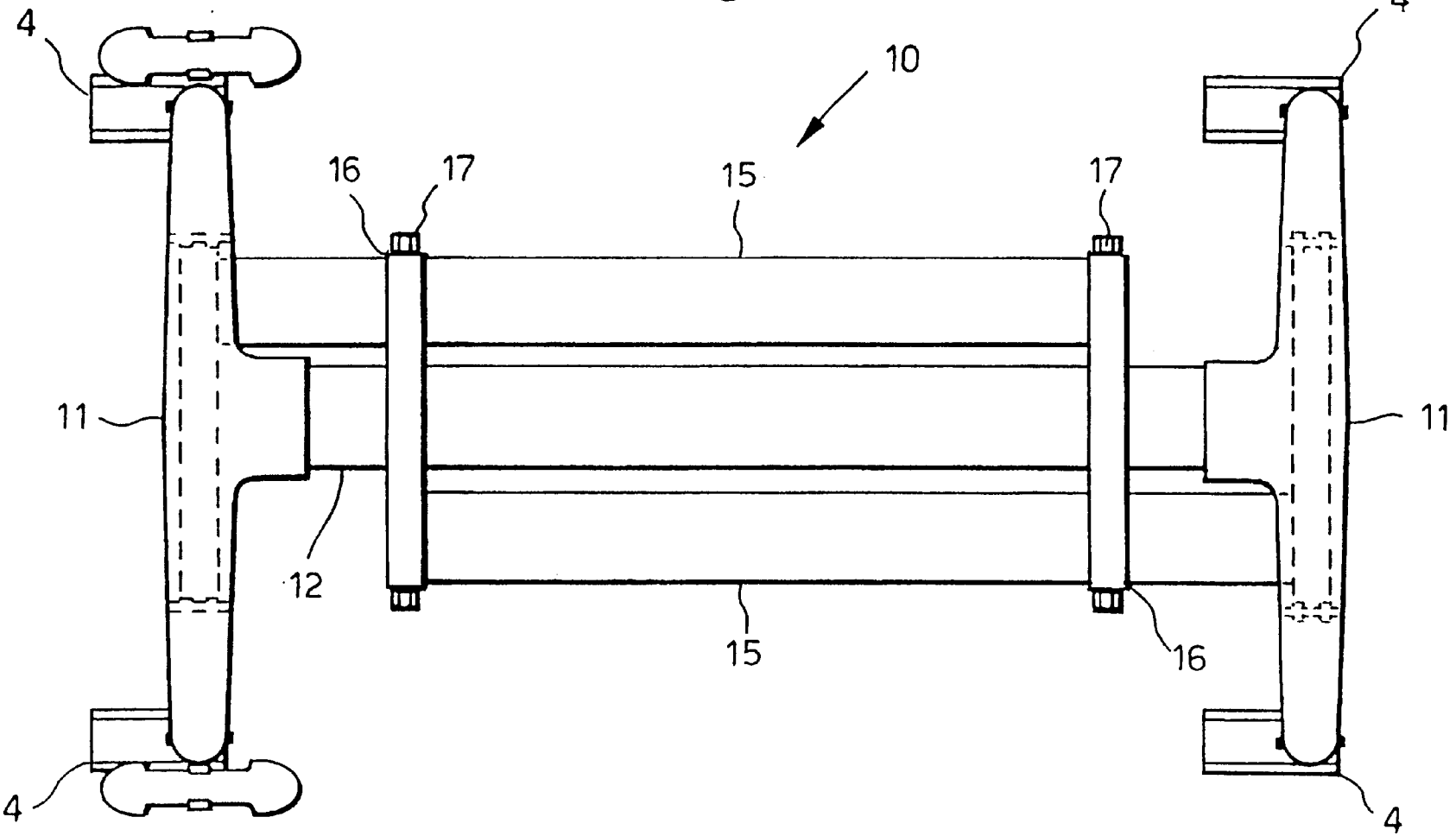
FIG. 1 is a plan view of the bed base frame according to the invention.

Referring to FIG. 1, the base frame 10 consists of two base end castings 11 joined by central base member 12, which is either a rolled section or extrusion. Four interlinked castors 4 are inserted into the base end castings 11 with the mechanism hidden internally in the castings and the central base member 12. An optional fifth tracking castor 5 may also be fitted in the central base member 12, as shown in FIG. 2.

Pivoted from the two base end castings 11 are two radius arms 15, one on either side of the central base member 12 and facing opposite directions. At the top end of each radius arm 15 is a cross-tube 16 into which are fitted two roller followers 17, one at either end of the cross tube 16.

Figure 2:
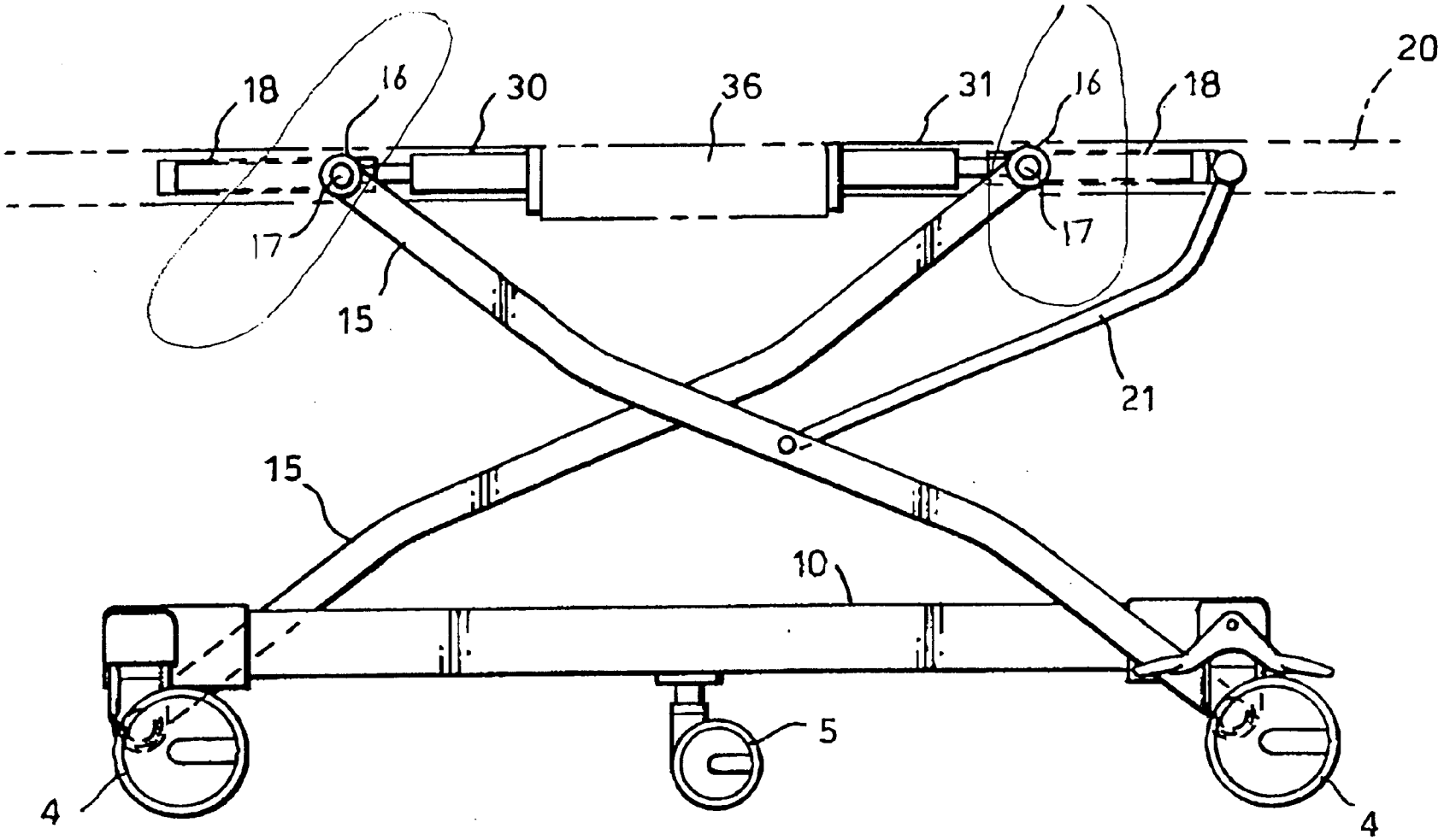
FIG. 2 is a side view of the bed with the bed base frame in FIG. 1 supporting an upper frame.

As shown schematically in FIG. 2, the radius arms 15 support the upper frame 20 by means of the roller followers 17 at each end of the cross tubes 16 cooperating with linear channels 18 on the sides of the upper frame 20. The cross tubes 16 are each connected to a linear actuator 30, 31 connected to suitable power supplies and to a central control housing 36 as explained later. The actuators 30, 31 upon extension or retraction push or pull the respective cross tubes 16 along the channels 18 by means of rollers 17. When the cross tubes 16 connecting the top ends of the radius arms 15 are pulled simultaneously then the upper frame 20 will rise at a level setting and a similar reverse action will produce a movement of the upper frame 20 in the reverse direction to the lowest position where the upper frame almost rests upon the base frame with the actuators and radius arms nestled in between the two frames as closely as practically possible. In this way the lowest minimum height maybe achieved.

If the top ends of the radius arms are driven in opposite directions then the upper frame 20 will tilt. The degree and direction of tilt is dependent on the movement of the two linear actuators 30, 31 which are controlled by a microprocessor as part of the bed or trolley control system. A stabilising link 21 connects the centre of one of the radius arms 15 to a fixed point on the upper frame 20 thereby eliminating any unwanted movement in the mechanism.

Figure 3:
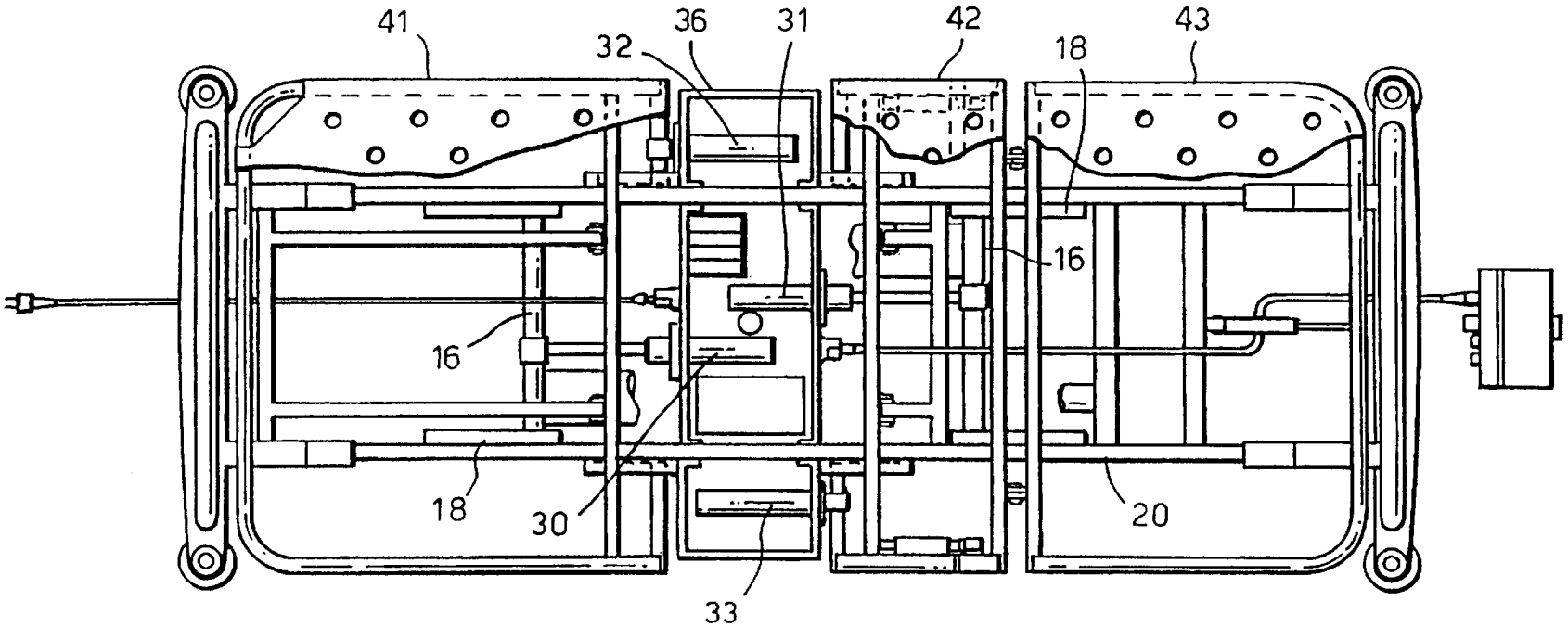
FIG. 3 is a plan view of the upper frame in FIG. 2 showing schematically the control housing and actuators.
Figure 4:
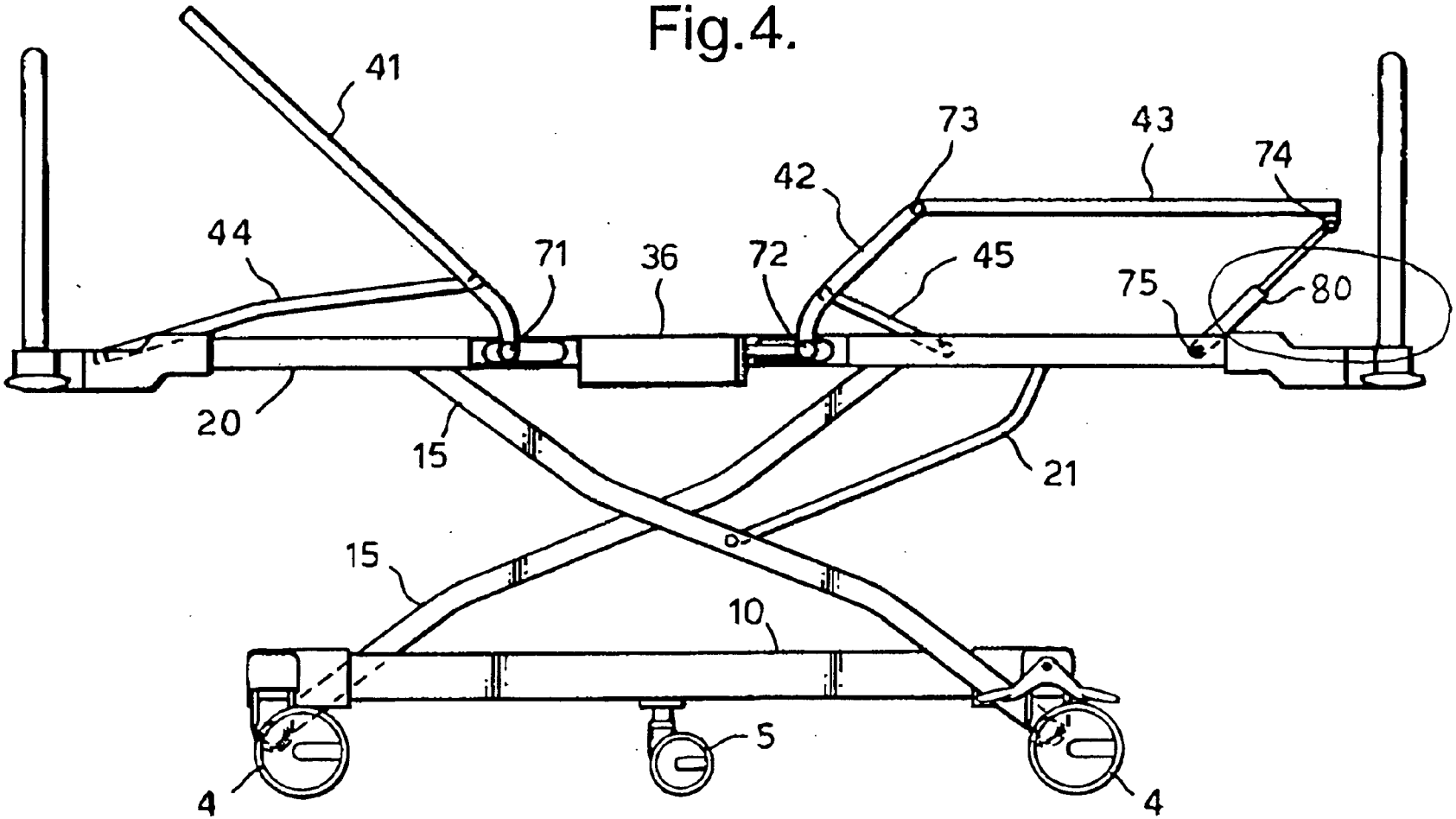
FIG. 4 is a side view of the bed with the upper frame supporting a platform.

Referring to FIGS. 3 and 4, actuator 32 imparts a horizontal force to the backrest section 41 via a pivoting and sliding joint 71 on upper frame 20. A link arm 44 is pivotally connected to the upper frame 20 and the backrest section 41. As actuator 32 pushes pivot. 71 horizontally, the backrest section 41 is compelled to rise due to the influence of the link arm 44. The resultant effect is that as the backrest section 41 rises, it also retracts towards the head end of the bed or trolley. Actuator 33 imparts a horizontal force to the thigh section 42 via a pivoting and sliding joint 72. A link arm 45 is pivotally connected to the upper frame 20 and thigh section 42. As actuator 33 pushes pivot 72, the thigh section 42 is compelled to rise due to the influence of the link arm 45. The resultant effect is that as the thigh section 42 rises, it also retracts towards the foot end of the bed or trolley.

The calf section 43 of the bed or trolley is connected at one end to the thigh section 42 via pivot 73 and supported at it's other end by an actuator 80. This actuator 80 is connected to the calf section 43 via pivot 74 and connected to the upper frame 20 via pivot 75. As the thigh section 42 is raised, the calf section 43 is also raised due to the direct link at pivot 73. The inclination of the calf section relative to the horizontal is governed by the stroke length of the calf elevation actuator 80.

FIG. 3 shows the bed or trolley control system housed in a control housing 36 situated approximately at the centre of the upper frame 20 and mounted directly or structurally integral to it.

Figure 5B:
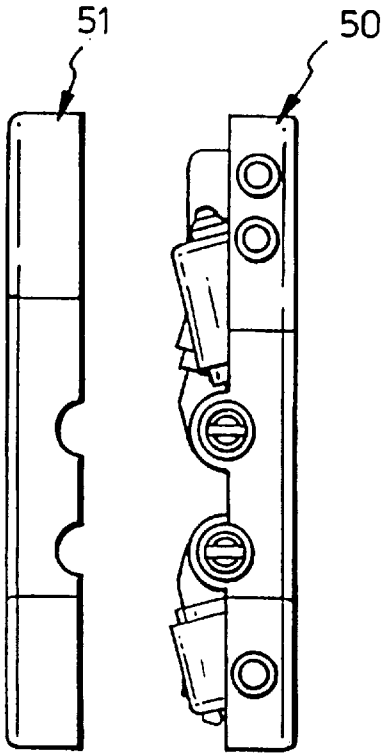
FIGS. 5*a* and 5*b* is a plan and side view respectively of a control housing and actuators of a preferred embodiment.
Figure 5A:
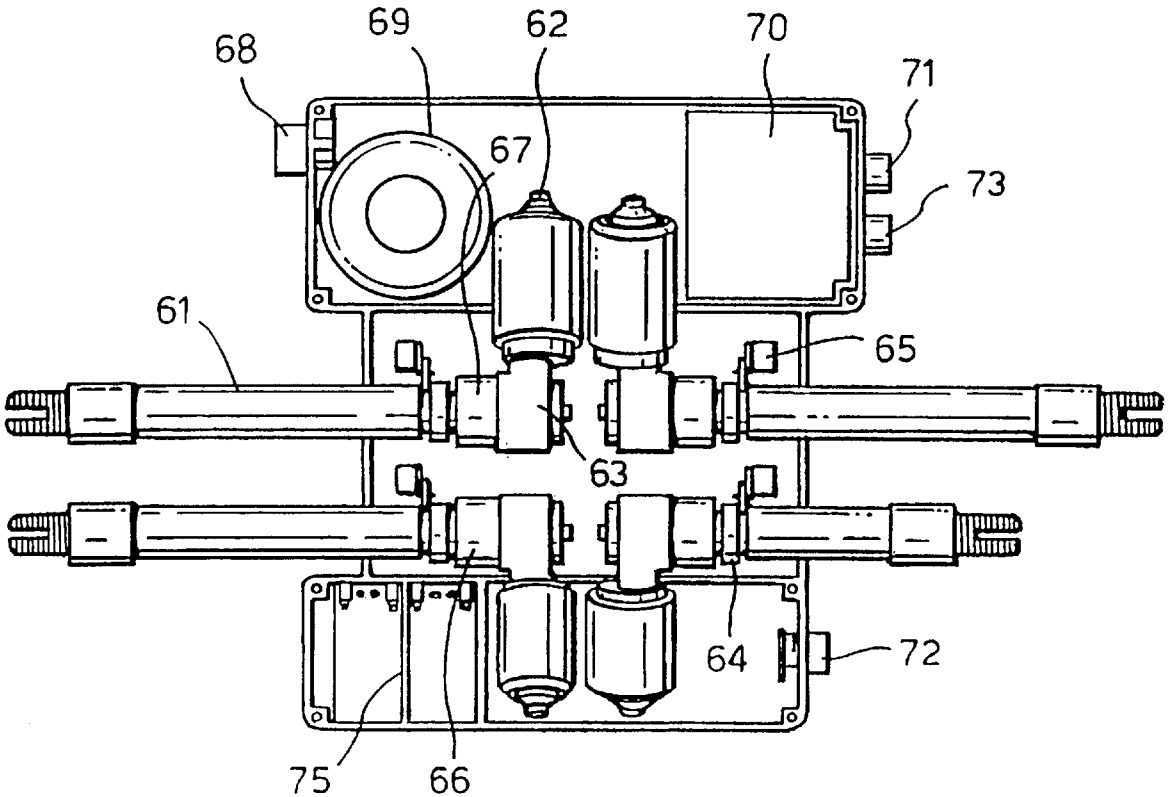
Figure 6:
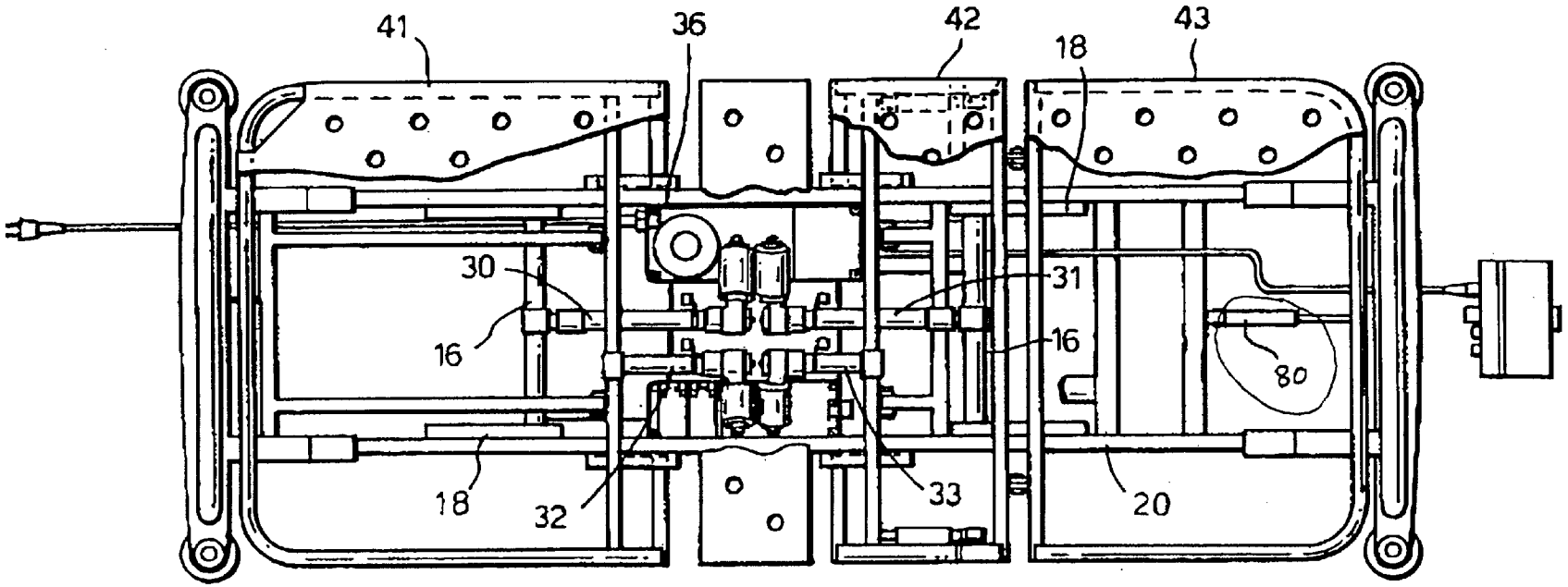
FIG. 6 is a plan view of a bed with the control housing and actuators shown in FIGS. 5*a* and 5*b*.
Figure 7:
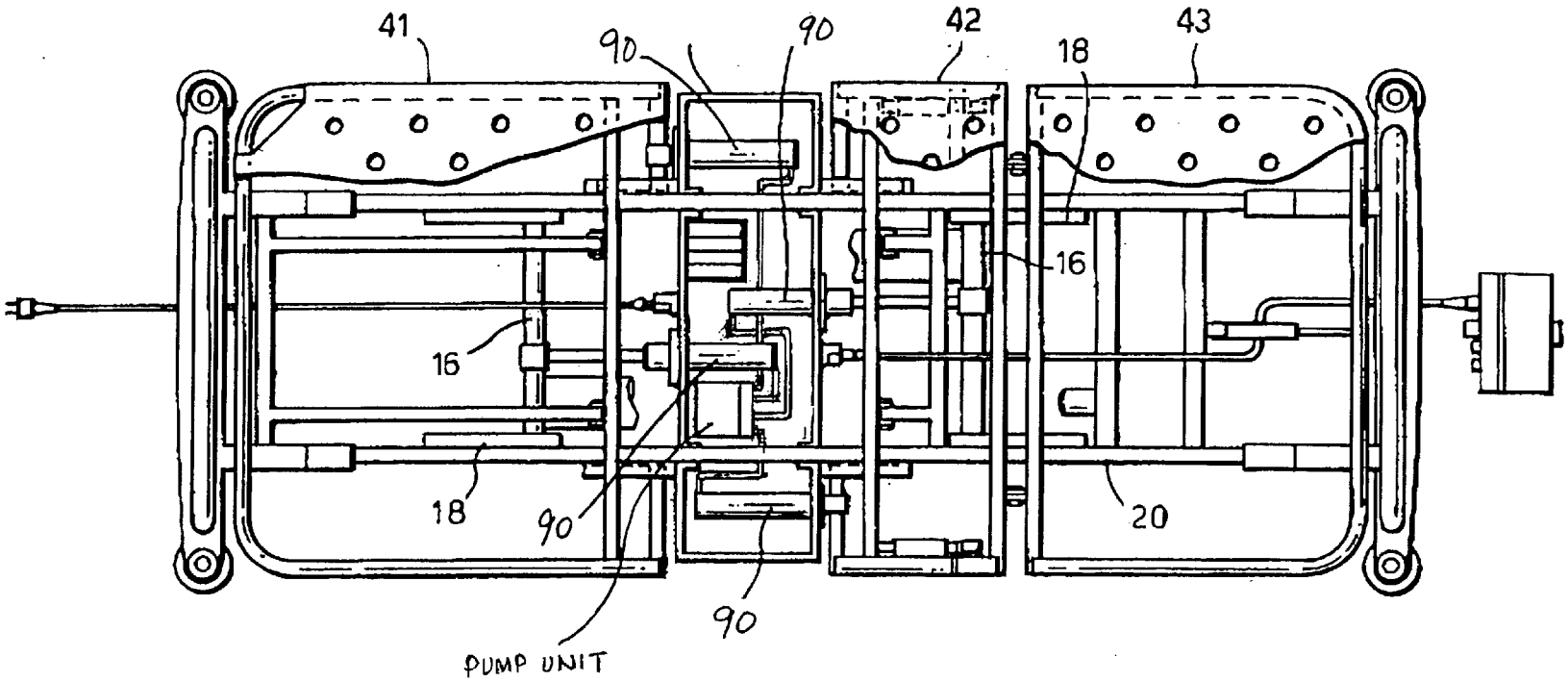
FIG. 7 is a plan view of an alternative embodiment of an upper frame according to the invention.

The control housing 36 may be constructed as a casting or moulding and houses all the linear actuators 30, 31 and 32, 33 for adjustment of the height of the upper frame 20 and profiling of the platform sections 41, 42, 43 respectively. In the preferred embodiment, as shown in FIGS. 5*a*, 5*b* the control housing 36 consists of two mouldings or castings 50, 51 that join together to form a housing for all the actuators and their controls. All joints between the two halves are sealed to prevent ingress of moisture. The control housing 36 may incorporate additional structural reinforcement in order to transmit all forces through to its connection with the upper frame 20.

The four actuators 31, 32, 33, 34 are fitted into this housing and are located on the same plane. Since the actuators are mounted for truly linear operation without any pivotal movement all the actuators may be fixedly secured to the control housing 36. Each actuator consists of a screw tube assembly 61, incorporating a lead screw and nut assembly, which is driven by a motor 62 via a gear reduction unit 63. All axial loads are taken by a thrust bearing 64 rigidly mounted onto the control housing mouldings.

Positional feedback of actuator stroke is measured by potentiometers 65 coupled to the actuator lead screw via gears or belts. Alternatively, positional feedback may be attained by other conventional means, for example pulse encoders.

The actuators may be fitted with a wrap spring clutch 66 operated to facilitate freewheeling. This allows backdriving of the actuator to allow quick release of the bed or trolley backrest from a raised position to a horizontal position for emergency procedures, for example CPR. The actuators include wrap spring brakes 67 to prevent backdriving in normal operation.

Mains power is connected via a socket 68 leading to a transformer 69 to produce the required control voltage. control board 70 within the housing controls the four actuators. Patient hand controls are connected via two sockets 71 and 72. Nurse controls may be connected via a further socket 73.

Batteries 75 may be included for emergency operation of the bed or trolley functions and are housed in a sealed compartment within the housing 36. The battery compartment may be externally vented to prevent build up of gases.

The control housing 36 may further accommodate other elements of the control system, for example, sensors, load cells, specific software for controlling the bed or trolley, and a light for illuminating the floor around the bed or trolley.

Other equipment such as pumps to operate air mattresses or inflatable garments for use by the patient may also be connected directly to the central control housing 36.

Although the preferred method of actuation is electromechanical, hydraulic cylinders may be used as actuators, being supplied by a pump unit, the actuators and pump all located within the control housing 36.

Another alternative form of actuation may comprise drive screws being driven by a motor all housed centrally within the control housing 36.

What is claimed is:

1. A patient support apparatus comprising a base frame supporting an upper frame, the upper frame having a platform for supporting a mattress, at least one powered actuator varying height and tilt of the upper frame and optionally at least one powered actuator for adjusting the profile of the platform wherein the at least one actuator for varying height and tilt is mounted centrally on the upper frame and arranged to lie substantially within the upper frame to achieve a very low minimum height of the patient support apparatus.

2. A patient support apparatus as claimed in claim 1 wherein the base frame supports the upper frame by at least a pair of support arms interconnecting the base frame and the upper frame, each of the arms pivotally connected to each end of the base frame and extending towards the opposite end of the upper frame and connected to the upper frame to position the upper frame in a minimum position where the arms are fully collapsed to positions where the arms are elevated to varying degrees, said arms actuated by the at least one actuator for varying height and tilt.

3. A patient support apparatus as claimed in claim 2, wherein the support arms are collapsible to position the upper frame to the minimum position under the weight of the upper frame, without use of the powered actuators.

4. A patient support apparatus as claimed in claim 1 wherein the actuators are mounted on the same plane within the upper frame.

5. A patient support apparatus as claimed in claim 4 wherein all the actuators are arranged to operate in a longitudinal direction parallel to the upper frame without any pivotal movement.

6. A patient support apparatus as claimed in claim 1 wherein the actuators are all located in a single housing.

7. A patient support apparatus as claimed in claim 6 wherein the housing also provides structural support to the actuators.

8. A patient support apparatus as claimed in claim 6 wherein said housing is arranged to span transversely centrally of the upper frame and located almost entirely within the upper frame.

9. A patient support apparatus as claimed in claim 8 wherein the housing may be located substantially under a seat section of the platform and optionally may be integral with the seat section of the platform to provide improved structural rigidity to the upper frame.

10. A patient support apparatus as claimed in claim 6 wherein the housing may include a pneumatic pump or means for attachment thereof in order to be able to supply compressed air to a pressure relieving mattress provided upon the platform.

11. A patient support apparatus as claimed in claim 10 wherein the pneumatic pump or means for attachment thereof supply compressed air to compression garments for treatment of a patient lying upon the bed.

12. A patient support apparatus as claimed in claim 1 wherein the actuators are controlled by control means also located within the housing.

13. A patient support apparatus comprising a base frame supporting an upper frame, the upper frame having a platform for supporting a mattress, at least one powered actuator for varying height and tilt of the upper frame and optionally at least one powered actuator for adjusting the profile of the platform wherein the at least one actuator for varying height and tilt is mounted centrally on the upper frame and arranged to lie substantially within the upper frame to achieve a very low minimum height of the patient support apparatus, wherein the at least one actuator for varying height and tilt is located within a housing, and wherein the housing includes means to illuminate a perimeter of the platform on the floor, to give a patient clear vision when entering or exiting the patient support apparatus when dark.

14. A patient support apparatus comprising a base frame supporting an upper frame, the upper frame having a platform for supporting a mattress, at least one powered actuator for varying height and tilt of the upper frame and optionally at least one powered actuator for adjusting the profile of the platform wherein the at least one actuator for varying height and tilt is mounted centrally on the upper frame and arranged to lie substantially within the upper frame to achieve a very low minimum height of the patient support apparatus, and wherein the at least one actuator for varying height and tilt is controlled by control means also located within a housing, and wherein the housing includes means to record a patient's physical data or characteristics, and means to communicate with a nurse interface module situated at a foot of the upper frame.

15. A patient support apparatus comprising a base frame supporting an upper frame, the upper frame having a platform for supporting a mattress, at least one powered actuator for varying height and tilt of the upper frame and optionally at least one powered actuator for adjusting the profile of the platform wherein the at least one actuator for varying height and tilt is mounted centrally on the upper frame and arranged to lie substantially within the upper frame to achieve a very low minimum height of the patient support apparatus, wherein load cells may be mounted on the at least one actuator for varying height and tilt to provide an indication of load applied to the platform when a patient is lying thereon, and converted to patient weight be a control means within a housing.

* * * * *